US006273601B1

(12) United States Patent
Hlávka et al.

(10) Patent No.: US 6,273,601 B1
(45) Date of Patent: Aug. 14, 2001

(54) POWER MIXER WITH HOLDING FRAME FOR RESTING ON A SURFACE

(75) Inventors: Květoslav Hlávka, Ceská Lipa (CZ); Manfred Kirchner, Neidlingen (DE)

(73) Assignee: Narex Ceska Lipa, A.S., Ceska Lipa (CZ)

( * ) Notice: Subject to any disclaimer, the term of this patent is extended or adjusted under 35 U.S.C. 154(b) by 0 days.

(21) Appl. No.: 09/611,747

(22) Filed: Jul. 7, 2000

(30) Foreign Application Priority Data

Jul. 17, 1999 (DE) ..... 299 12 548 U

(51) Int. Cl.[7] ..... B01F 15/00
(52) U.S. Cl. ..... 366/129
(58) Field of Search ..... 366/64, 65, 129, 366/349; 173/170; 416/69, 70 R; 16/125; 81/489; D8/DIG. 7

(56) References Cited

U.S. PATENT DOCUMENTS 1,051,331 * 1/1913 Holtman .
1,856,065 * 5/1932 Austin .
1,928,965 * 10/1933 Dormeyer .
2,093,586 * 9/1937 Day .
2,430,817 * 11/1947 Jackson .
2,552,023 * 5/1951 Andresen .
2,598,565 * 5/1952 Lagant .
2,975,848 * 3/1961 Roberts .
3,166,303 * 1/1965 Chapman .
3,333,831 * 8/1967 Chapman .
3,828,861 * 8/1974 Verkuil .
5,772,318 * 6/1998 Vadnais ..... 366/129

* cited by examiner

*Primary Examiner*—Charles E. Cooley
(74) *Attorney, Agent, or Firm*—Hoffmann & Baron, LLP

(57) ABSTRACT

A power mixer comprises a drive unit with a drive motor for driving a paddle rod, a handle arrangement with two handles arranged on either side of the axis of the paddle rod for two handed holding of the power mixer during mixing and a holding frame attached to the housing of the drive unit. The two handles are arranged on both sides of the drive unit on the holding frame. The holding frame defines a support face to which a normal is athwart the axis of the paddle rod. The mixer may be put down on an adjacent floor area with the paddle rod clear of the floor.

16 Claims, 2 Drawing Sheets

1
10
50
22
9
21
36
38
3
2
40
33
13
14
39
39
25
35
30
31
37
8
17
15
4
11
5
6

6
5
2
8
15
13
9
30
25
10
12
23
50
25
10
50
6
5
8
12
30
15
2
9
13

POWER MIXER WITH HOLDING FRAME FOR RESTING ON A SURFACE

BACKGROUND OF THE INVENTION

The invention relates to a power mixer comprising a drive unit with a drive motor for driving a paddle rod, a handle arrangement with two handles arranged on either side of the axis of the paddle rod for two handed holding of the power mixer during mixing and a holding frame attached to the housing of the drive unit.

THE PRIOR ART

Such power mixers to be held in both hands are more particularly employed in various trades and serve for the mixing of liquids, which may be viscous, and other materials as for example mortar, plaster, screed compositions for floors, adhesives or paints.

Power mixers have already been proposed, in the case of which one of the handles is arranged on the drive unit and the other one is arranged on a holding frame connected with the drive unit. If the mixer is placed on the ground, for example for a pause between mixing operations or for changing the paddle rod, there is a danger of the paddle rod coming into contact with the floor near it and of soiling the floor or itself picking up dirt from the floor.

SHORT SUMMARY OF THE INVENTION

The present invention is intended to provide a remedy in this respect by providing a design in which both handles are arranged on both sides of the drive unit on the holding frame and the holding frame defines a support face to which a normal is athwart axis of the paddle rod, such support face allowing the mixer to be put down on an adjacent floor area with the paddle rod clear of the floor.

Accordingly there is a holding frame, which constitutes the two handles, so that no separate drive unit with its own handle is necessary. Furthermore, it is possible for the power mixer to be placed on the ground when not in use without the paddle rod touching the floor.

It is convenient for the support face to be constituted by a stand of the holding frame, one of the handles being arranged on the stand. This means that the stand may perform a second function as a handle by which the mixer may be held.

The stand part forming the handle may have a grip sleeve, more particularly of polyurethane, produced by forming a foam layer.

In the case of a preferred embodiment there is a provision such that the two handles project past the drive unit on the top side of the unit opposite to the paddle rod and together constitute a stand means, allowing the power mixer to be put down on the adjacent floor with the paddle rod directed away from the floor. Accordingly the mixer can not only be put down using the support stand with the paddle rod in parallelism to the adjacent floor but also using the stand means, formed by the two handles, with the paddle rod pointing upward. This position is more especially an advantage for fitting or changing the paddle rod.

The handle opposite to the stand preferably extends essentially perpendicularly to the plane of the stand so that such handle, the drive unit and the middle of the translation rib of the U-like member, as seen looking in the direction of the axis of the paddle rod, are substantially flush on a single line.

In the case of an embodiment of the invention which is particularly advantageous as regards handling there is a provision of an on-off switch for the drive motor arranged on one of the handles and preferably on the handle opposite to the stand. In this case it is possible for the power cable to extend between the drive unit and the on-off switch in a piece of tube so that it is protected and out of sight.

Further advantageous developments of the invention are defined in the claims.

One embodiment of the invention will now be described with reference to the accompanying drawings.

LIST OF THE SEVERAL FIGURES OF THE DRAWINGS

DETAILED ACCOUNT OF WORKING EMBODIMENT OF THE INVENTION

Figures 1, 2, 3:
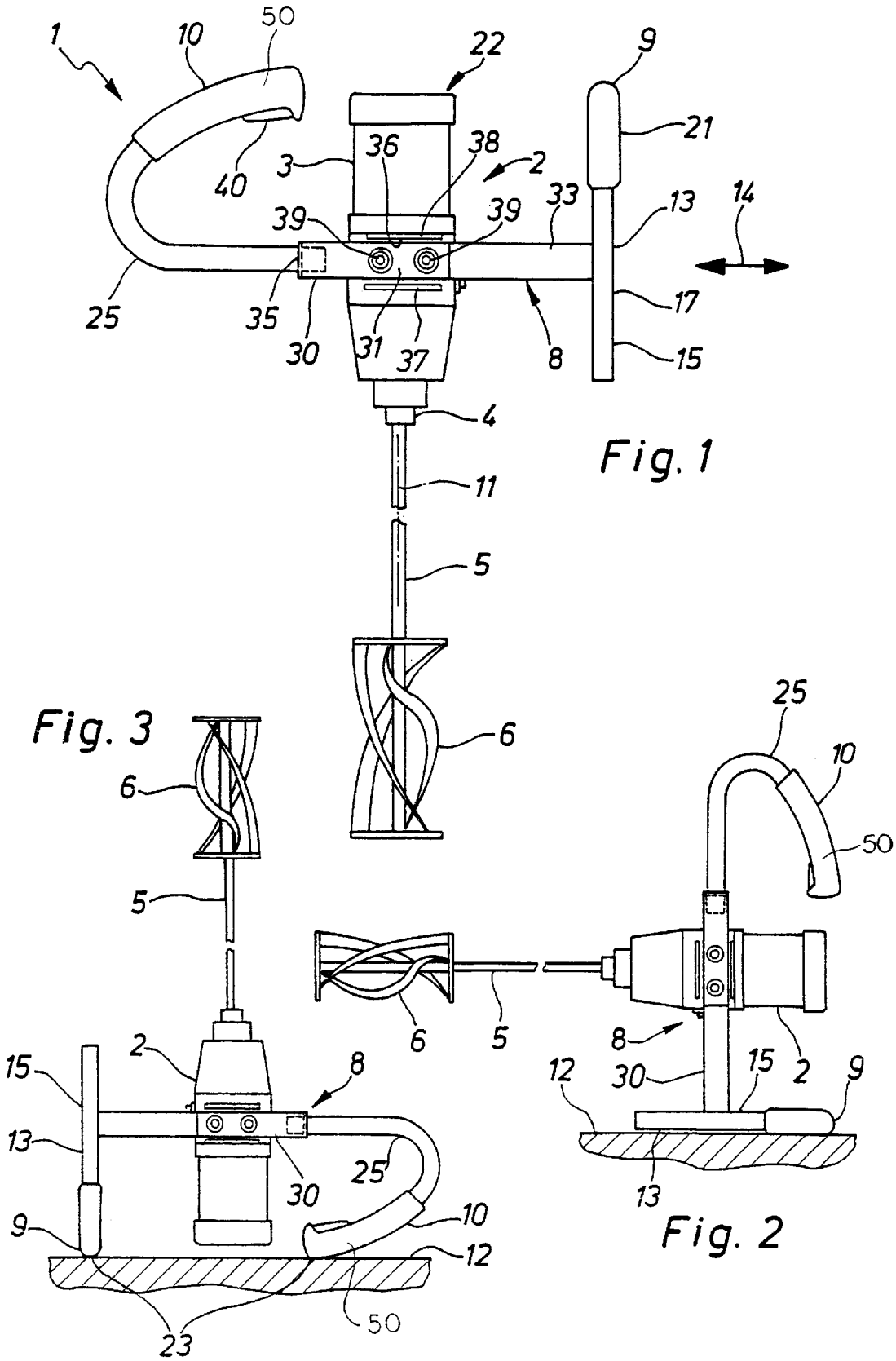
FIG. 1 shows the power mixer in a side view during use.
FIG. 2 shows the power mixer of FIG. 1 when not in use, the support face defined by the holding frame being in contact with the ground.
FIG. 3 shows the same power mixer in another position out of use in which the paddle rod is directed upward and the mixer has its stand means, constituted by the two handles, resting on the ground.

The power mixer 1 illustrated in the drawings comprises a drive unit 2 with a drive motor accommodated in the interior of the drive unit 2, that is to say in the interior of the drive unit housing 3, such motor driving a drive shaft, with which, using a suitable coupling means 4, an interchangeable paddle rod 5 may be connected for torque transmission, the paddle rod having paddle means 6 at the its end opposite to the drive unit. During operation the power mixer 1 held so that the paddle means 6 dips into the medium to be mixed.

The drive unit 2 is electrically driven. The power cable 7 leading to the drive motor is omitted in FIGS. 1 through 3 and only illustrated partly cut away in FIG. 4.

On the housing 3 of the drive unit 2 a holding frame 8 is attached, on which two handles 9 and 10 are arranged, which are located on either side of the drive unit 2 and accordingly on either side of the axis 11 of the paddle rod. The power mixer 1 may be held in both hands by means of such handles 9 and 10. In FIG. 1 the position of use is depicted, in which the user holds the two handles 9 and 10, one in each hand, in a manner which is not illustrated.

If the power mixer 1 is not used, it can be put down on the adjacent floor 12. This function is integrated in the holding frame 8, which for this purpose defines a support face 13, whose perpendicular or normal direction 14 is aligned athwart the axis 11 of the paddle rod so that the paddle rod 5—when the power mixer 1 has its support face 13 resting on the adjacent floor—is spaced from the floor 12 and essentially parallel to same (FIG. 2).

The support face 13 is defined by a stand 15 as a part of the holding frame 8. In this case the stand 15 serves not only for standing the power mixer 1 on the floor 12 but also for holding the power mixer 1 when in use, since at the same time it constitutes the handle 9. The handle 9 is then formed by a transverse rib 16 of the stand, which extends athwart the axis 11 of the paddle rod and athwart a perpendicular 14 drawn to the support face. In the working example of the invention the U-like configuration of the stand 15 is such that on its two ends of the transverse rib 16 a limb 17 and, respectively, 18 is attached extending therefrom. Both the transverse rib 16 of the stand and also the two limbs 17 and 18 of the letter U contribute to forming the support face 13.

The transverse rib 16 of the stand is arranged at the top when the mixer is in use.

It is convenient for the stand 15 to be at least substantially constituted by an integral and suitably bent tube 19. The ends of the tube 19, i. e. the free ends of the limbs 17 and 18 of the stand, may be closed by terminal plugs 20.

The portion of the stand constituting the handle 9, has a grip 21 produced by foaming synthetic resin on the preferably metallic material of the stand, such synthetic resin preferably being polyurethane.

It will be clear that the support face 13 is so arranged and designed that the power mixer 1, when resting thereon, cannot topple over, even when the paddle rod 5 is attached.

As shown in FIG. 3 it is furthermore possible for the power mixer to be so stood on the floor 12 that the paddle rod 5 is directed upward away from the adjacent floor 12. For this purpose the two handles 9 and 10 on the top side 22, opposite to the paddle rod 5, of the drive unit 2, which in FIG. 3 is at the bottom, extend past the drive unit and together constitute a stand means 23. The portion, constituting the handle 9, of the stand 15 is consequently also a component of the stand means 23.

The handle 10 opposite to the stand 15 extends essentially athwart the plane defined by the stand 15. Accordingly this handle 10, the drive unit 2 and the middle 24 of the transverse rib 16 of the stand, will be seen to be essentially flush with one line on looking in the direction of the axis 11 of the paddle rod. This means that there is a symmetrical arrangement with an equalized distribution of weight of the mixer when being used.

On its side, on which there is the handle 10, opposite to the support face the holding frame 8 possesses a support or carrying arm 25 extending out away from the drive unit 2 more or less radially, and then upward and back again toward the drive unit 2, where the arm 25 comes to an end.

Its terminal portion at the free end forms or bears the handle 10. In the illustrated working embodiment the handle 10 is constituted by half shells 50 secured to the support arm 25.

In the working embodiment the support arm 25 also consists of a single piece of curved tube 26.

On looking in the direction 14 normal to the support face, the stand 15 will appear projecting past both sides of the drive unit 2. This is because the transverse rib 16 of the stand has a sufficient length. The arrangement is furthermore so designed that the support arm 25 projects so far from the drive unit 2 that, as seen looking in the direction of the axis 11 of the paddle rod, the drive unit 2 is arranged so that on either side it has an inward clearance from the connection line between the outermost point 27 on the on the support arm 25 and the outermost point 28 and, respectively, 29 on the stand 15. These two points 28 and 29 laterally to the outside on the stand 15 are formed by its limbs 17 and 18. If it is therefore imagined that a respective connecting line extends on each side of the drive unit 2 so that the line runs between the point 27, furthest from the drive unit 2, of the support arm 25 as far as the respective laterally outermost point 28 and, respectively, 29 on the stand 15, such connecting lines will extend with a clearance past the drive unit 2. This means that the drive unit 2 is protected on these sides if the power mixer 1 is placed on one of such sides or topples over.

The holding frame 8 comprises an U-like attachment part 30, which fits around the drive unit 2 and has its two lateral limbs 31 and 32 attached to the housing of the drive unit 2. The stand 15 is mounted on the end region of the two lateral limbs 31 and 32, one of the lateral limbs being connected with one of the two stands limbs 17 and 18 preferably by welding. Adjacent to the drive unit 2 the two attachment lateral limbs 31 and 32 of the stand extend in parallelism to each other. Then their limb parts 33 and 34 diverge from one another like a letter V toward the stand 15. The two lateral limbs 31 and 32 are connected together at the end remote from the stand 15 by means of a connecting part 35 fitting around the drive unit 2 so that the U-like appearance of the attachment part 30 results. The support arm 25 projects from this connecting part 35.

For adequately holding the attachment part 30 on the drive housing 3 at its two facing outer sides the latter possesses a trough-like recess 36, whose width is the same as that of the lateral limbs 31 and 32 of the U-like attachment part. In the illustrated working embodiment the two tough-like recesses 36 (of which only one is to be seen in the drawing) are delimited by two ribs 37 and 38 on and extending away from the drive part 3 between which the respective lateral limbs 31 and 32 are held. The lateral limbs 31 and 32 held in this manner are screwed to the drive housing 3 (by attachment screws 39).

The attachment part 30 is made of flat strip material, which is conveniently in one piece and is suitably bent.

The U-like attachment part 30 consists, like the stand 15 and the support arm 25 of metal, apart from the grip 21 and the handle 10.

The electrical drive motor in the unit housing 3 may be turned on and off by means of an on-off switch 40. In the present case it is a question of a press button switch. The on-off switch 40 is arranged on one of the handles and preferably on the handle 10 mounted on the support arm opposite to the stand 15. The handle 10 used for holding such grip may therefore also operate the switch 40.

The electrical power cable 41, which extends between the drive unit 2 and the on-off switch 40, runs in a tube forming part of the holding frame 8 and in the working example through tube 26 forming the support arm 25. This means that the power cable 41 is protected and does not interfere with handling of the power mixer 1.

Figure 4:
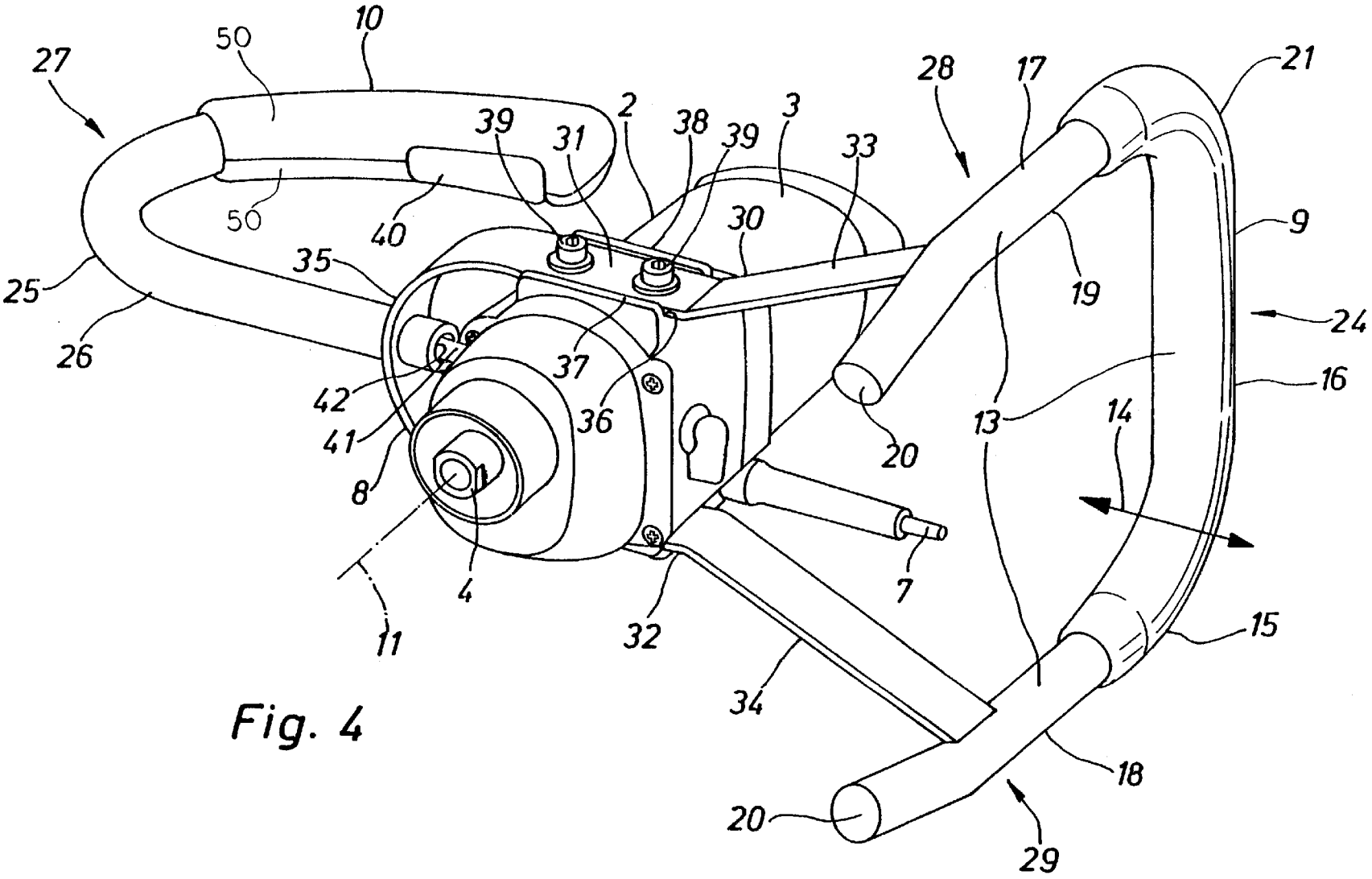
FIG. 4 shows the power mixer of FIGS. 1 and 2 without the paddle rod in an oblique view.

It will be seen from FIG. 4 that the tube 26 constituting the support arm 25 extends through the connecting part 35 of the attachment part 30 to the drive unit 2 where it ends. The power cable 41 extends through the open end 42 of the support arm 25 in same as far as the switch 40.

What is claimed is:

1. A power mixer comprising a drive unit with a drive motor for driving a paddle rod, a handle arrangement with a first and second handle arranged on either side of the axis of the paddle rod for two handed holding of the power mixer during mixing and a holding frame attached to a housing of the drive unit, wherein the first and second handles are arranged on opposite sides of the drive unit on the holding frame and wherein the first handle defines a first support face which is substantially parallel to the axis of the paddle rod, and wherein said first and second handles, in combination, define a second support face which is substantially perpendicular to the axis of the paddle rod, such support faces allowing the mixer to be put down on an adjacent floor area with the paddle rod clear of the floor in one of a horizontal or a vertical orientation.

2. The power mixer as set forth in claim 1, wherein the first support face is formed by a stand forming part of the holding frame and the first handle on the stand.

3. The power mixer as set forth in claim 2, wherein the first handle is formed by a transverse rib of the stand extending perpendicularly to the axis of the paddle rod and perpendicularly to the first support face.

4. The power mixer as set forth in claim 3, wherein the stand has a U-like configuration with limbs of the U projecting from the transverse rib of the letter U.

5. The power mixer as set forth in claim 4, wherein the transverse rib of the U is arranged at the top in the position of use.

6. The power mixer as set forth in claim 4, wherein the U-like stand is essentially constituted by a single piece, curved tube.

7. The power mixer as set forth in claim 2, wherein the second handle extends substantially perpendicularly to the plane of the stand.

8. The power mixer as set forth in claim 7, wherein the holding frame includes a support arm extending away from the drive unit, then upward and then toward the drive unit, where the support arm ends, the support arm bearing the second handle.

9. The power mixer as set forth in claim 8, wherein the stand, as seen in a direction normal to the first support face, extends so far past the drive unit that as seen in the direction of the axis of the stand the drive unit is arranged with an inward clearance from the connecting line between the outermost point on the support arm and the outermost point on the stand.

10. The power mixer as set forth in claim 8, wherein the support arm is formed by a single piece of curved tube.

11. The power mixer as set forth in claim 8, wherein the holding frame comprises a U-like attachment part, which fits around the drive unit and has two lateral limbs secured to the drive unit, the stand being mounted on the end portions of the lateral limbs and the support arm projecting from the U-like attachment connecting the lateral limbs.

12. The power mixer as set forth in claim 11, wherein the lateral limbs of the U-like attachment part respectively run in a trough-like recess externally of the drive unit and are screwed in place here.

13. The power mixer as set forth in claim 11, further including an on-off switch for the drive motor arranged on one of the first and second handles.

14. The power mixer as set forth in claim 13, further including an electrical supply cable extending between the drive unit and the on-off switch in the tube forming part of the holding frame.

15. The power mixer as set forth in claim 14, wherein the tube is open at one end held by the U-like attachment part, the supply cable extending through the open end as far as the on-off switch.

16. The power mixer as set forth in claim 1 wherein at least one of the first and second handles includes a grip sleeve comprising a foamed material.

* * * * *